US009437164B2

(12) United States Patent
Zhao

(10) Patent No.: US 9,437,164 B2
(45) Date of Patent: Sep. 6, 2016

(54) METHOD AND DEVICE FOR DETECTING A SYNCHRONIZATION SIGNAL OF A DISPLAY, AND DISPLAY

(71) Applicants: BOE TECHNOLOGY GROUP CO., LTD., Beijing (CN); Beijing BOE Vision-Electronic Technology Co., Ltd., Beijing (CN)

(72) Inventor: Jiaqing Zhao, Beijing (CN)

(73) Assignees: BOE TECHNOLOGY GROUP CO., LTD., Beijing (CN); BEIJING BOE VISION-ELECTRONIC TECHNOLOGY CO., LTD., Beijing (CN)

( * ) Notice: Subject to any disclaimer, the term of this patent is extended or adjusted under 35 U.S.C. 154(b) by 182 days.

(21) Appl. No.: 14/369,472

(22) PCT Filed: Nov. 15, 2013

(86) PCT No.: PCT/CN2013/087243

§ 371 (c)(1),
(2) Date: Jun. 27, 2014

(87) PCT Pub. No.: WO2015/010395

PCT Pub. Date: Jan. 29, 2015

(65) Prior Publication Data

US 2015/0077424 A1 Mar. 19, 2015

(30) Foreign Application Priority Data

Jul. 24, 2013 (CN) ..... 2013 1 0314638

(51) Int. Cl.
*G09G 5/18* (2006.01)
*G09G 5/39* (2006.01)

(Continued)

(52) U.S. Cl.
CPC ..... *G09G 5/12* (2013.01); *G09G 5/008* (2013.01); *G09G 5/30* (2013.01)

(58) Field of Classification Search
None
See application file for complete search history.

(56) References Cited

U.S. PATENT DOCUMENTS 6,097,444 A 8/2000 Nakano
6,124,850 A * 9/2000 Matsubara ..... G09G 5/006 345/204

(Continued)

FOREIGN PATENT DOCUMENTS

CN 1281154 A 1/2001
CN 1130585 C 12/2003
CN 101430874 A 5/2009

OTHER PUBLICATIONS

Notification of the First Office Action dated Apr. 23, 2015 corresponding to Chinese application No. 201310314638.8.

(Continued)

*Primary Examiner* — Yingchun He
(74) *Attorney, Agent, or Firm* — Nath, Goldberg & Meyer; Joshua B. Goldberg; Stanley N. Protigal

(57) ABSTRACT

A method for detecting a synchronization signal of a display comprises: obtaining an actual V-sync frequency of the display, comparing the actual V-sync frequency with standard V-sync frequencies prestored in a standard synchronization signal table, and selecting a standard V-sync frequency as a candidate V-sync frequency so that difference between the candidate V-sync frequency and the actual V-sync frequency is within a first error range; obtaining an actual H-sync frequency of the display, comparing the actual H-sync frequency with standard H-sync frequencies in the standard horizontal synchronization signal sub-table which corresponds to the selected candidate V-sync frequency, and selecting a standard H-sync frequency as a correct H-sync frequency so that difference between the correct H-sync frequency and the actual H-sync frequency is within a second error range, thereby a resolution of the display is obtained.

14 Claims, 2 Drawing Sheets

(51) Int. Cl.

| | |
|---|---|
| ***G09G 5/00*** | (2006.01) |
| ***G09G 5/12*** | (2006.01) |
| ***G09G 5/30*** | (2006.01) |

(56) References Cited

U.S. PATENT DOCUMENTS

2005/0285883 A1* 12/2005 Chen ..... G09G 5/003
345/698

2009/0079870 A1* 3/2009 Matsui ..... G09G 5/008
348/558

OTHER PUBLICATIONS

Written Opinion of the International Searching Authority dated Apr. 24, 2014 corresponding to International application No. PCT/CN2013/087243.

Search Report issued in International Application No. PCT/CN2013/087243, twelve (12) pages.

* cited by examiner

METHOD AND DEVICE FOR DETECTING A SYNCHRONIZATION SIGNAL OF A DISPLAY, AND DISPLAY

This is a National Phase Application filed under 35 U.S.C. 371 as a national stage of PCT/CN2013/087243, filed Nov. 15, 2013, and claims priority benefit from Chinese Application No. 201310314638.8, filed Jul. 24, 2013, the content of each of which is hereby incorporated by reference in its entirety.

FIELD OF THE INVENTION

The invention relates to the field of display manufacturing technology, and in particular, to a method and a device for detecting a synchronization signal of a display, and a display.

BACKGROUND OF THE INVENTION

A frequency of vertical synchronization signal (V-sync frequency) and a frequency of horizontal synchronization signal (H-sync frequency) (which can be collectively called frequencies of synchronization signal) of a display are key parameters of the display, the former equals to a refresh frequency and the latter relates to a resolution. To ensure that the above two frequencies synchronize with each other, the V-sync frequency and the H-sync frequency of the display are firstly detected, then they are compared with standard H-sync frequencies and standard V-sync frequencies respectively, so that a correct frequency of synchronization signal may be obtained, thereby the display may display images.

Currently, in the detection of the correct synchronization signal, a detection of the V-sync frequency and a detection of the H-sync frequency are usually performed at the same time. Specifically, the detection of the correct synchronization signal comprises: a first step, creating a standard synchronization signal table (including standard V-sync frequencies and standard H-sync frequencies) in a memory, wherein, in the standard synchronization signal table, the standard H-sync frequencies are associated with the standard V-sync frequencies and resolutions; a second step, detecting a V-sync frequency and a H-sync frequency of the display; a third step, comparing the detected frequencies with the standard frequencies of synchronization signal in the standard synchronization signal table one by one, and when both the V-sync frequency and the H-sync frequency satisfy an error range allowed by the standard V-sync frequencies and an error range allowed by the standard H-sync frequencies, respectively, then it is regarded that a correct frequency of synchronization signal is obtained, thus a resolution of the display may be obtained, and the detection is completed; however, if no correct frequency of synchronization signal is obtained from the table, then it indicates that there is something wrong with the synchronization of the display. With the above method for detecting the synchronization signal, the resolution of the display may be obtained according to the V-sync frequency and the H-sync frequency of the display, wherein the resolution may play a key role in setting parameters such as a refresh frequency for the display.

The inventor of the application find that there are at least following problems in the prior art: as the standard V-sync frequencies and the standard H-sync frequencies are created in the same table, so a large capacitance of the table is required and the arrangement of the frequencies is irregular and complicated, therefore, when the detected V-sync and H-sync frequencies of the display are compared with those in the table, the procedure is complicated and low in speed.

SUMMARY OF THE INVENTION

To solve the above defects in the detection of the synchronization signal of the display, the invention provides a method and a device for detecting the synchronization signal of the display, and a display.

A solution adopted in the invention to address above problems is a method for detecting a synchronization signal of a display, the method comprises the steps of:

obtaining an actual frequency of vertical synchronization signal of the display, comparing the actual frequency of vertical synchronization signal with standard frequencies of vertical synchronization signal prestored in a standard synchronization signal table, and selecting a standard frequency of vertical synchronization signal from the standard synchronization signal table as a candidate frequency of vertical synchronization signal so that difference between the candidate frequency of vertical synchronization signal and the actual frequency of vertical synchronization signal of the display is within a first error range, wherein the standard synchronization signal table stores the standard frequencies of vertical synchronization signal and standard horizontal synchronization signal sub-tables corresponding to the standard frequencies of vertical synchronization signal, each standard horizontal synchronization signal sub-table stores all standard frequencies of horizontal synchronization signal and resolutions corresponding to one standard frequency of vertical synchronization signal;

obtaining an actual frequency of horizontal synchronization signal of the display, comparing the actual frequency of horizontal synchronization signal with the standard frequencies of horizontal synchronization signal in the standard horizontal synchronization signal sub-table which corresponds to the selected candidate frequency of vertical synchronization signal, and selecting a standard frequency of horizontal synchronization signal from the standard horizontal synchronization signal sub-table as a correct frequency of horizontal synchronization signal so that difference between the candidate frequency of horizontal synchronization signal and the actual frequency of horizontal synchronization signal is within a second error range.

Preferably, before obtaining the actual frequency of vertical synchronization signal of the display, the method further comprises: prestoring the standard synchronization signal table in the memory.

Preferably, the first error range is from −1 Hz to 1 Hz.

Preferably, the second error range is from −1 Hz to 1 Hz.

Preferably, if a plurality of candidate frequencies of vertical synchronization signal are obtained and at least two of the standard frequencies of horizontal synchronization signal corresponding to the plurality of candidate frequencies of vertical synchronization signal are identical, the first error range is narrowed down to obtain a new first error range, and candidate frequencies of vertical synchronization signal are reselected according to the new first error range.

Preferably, the method further comprises: when there is no correct frequency of horizontal synchronization signal obtained, a new standard frequency of horizontal synchronization signal is added to the standard horizontal synchronization signal sub-table, so as to obtain a new standard horizontal synchronization signal sub-table. Further preferably, a correct frequency of horizontal synchronization signal is obtained from standard frequencies of horizontal synchronization signal in the new standard horizontal synchronization signal sub-table.

Further preferably, the standard frequencies of vertical synchronization signal in the standard synchronization signal table are from 55 Hz to 76 Hz and values thereof are integers.

A solution adopted in the invention to address above problems is a device for detecting a synchronization signal of a display, the device comprises: a memory unit for storing a standard synchronization signal table, wherein the standard synchronization signal table stores standard frequencies of vertical synchronization signal and standard horizontal synchronization signal sub-tables corresponding to the standard frequencies of vertical synchronization signal, each standard horizontal synchronization signal sub-table stores all standard frequencies of horizontal synchronization signal and all resolutions corresponding to one standard frequency of vertical synchronization signal; a unit for detecting an actual frequency of vertical synchronization signal of the display; a unit for detecting an actual frequency of horizontal synchronization signal of the display; a unit for obtaining a standard frequency of vertical synchronization signal as a candidate frequency of vertical synchronization signal so that difference between the candidate frequency of the vertical synchronization signal and the actual frequency of vertical synchronization signal is within a first error range; a unit for obtaining a standard frequency of horizontal synchronization signal as a correct frequency of horizontal synchronization signal so that difference between the correct frequency of horizontal synchronization signal and the actual frequency of horizontal synchronization signal is within a second error range, by comparing the standard frequencies of horizontal synchronization signal in the standard horizontal synchronization signal sub-table corresponding to the candidate frequency of vertical synchronization signal with the actual frequency of horizontal synchronization signal, thereby a resolution of the display is obtained.

The invention further provides a display comprising the above device for detecting a synchronization signal of a display.

The method and the device for detecting a frequency of a synchronization signal of a display and the display can detect the synchronization signal of the display quickly and accurately, because they firstly perform detecting so as to obtain the candidate frequency of vertical synchronization signal, then perform detecting so as to obtain a correct frequency of horizontal synchronization signal, and finally a resolution of the display is obtained.

DETAILED DESCRIPTION OF THE EMBODIMENTS

In order to make the skilled persons in the art understand the technical solutions of the present invention best, the invention will be described in detail in conjunction with the embodiments and accompanying drawings.

The First Embodiment

Figure 1:
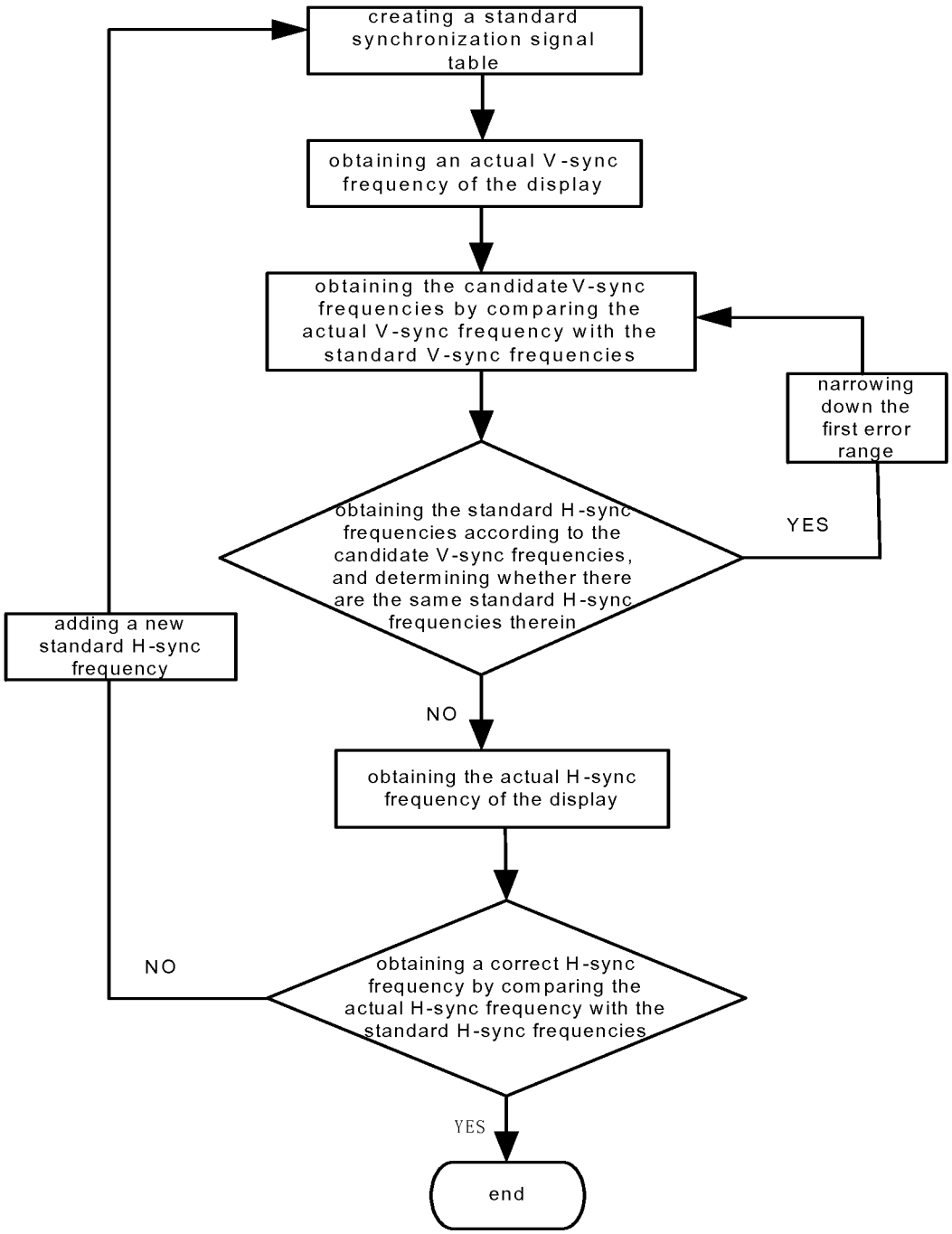
FIG. 1 is a flowchart illustrating a method for detecting a synchronization signal of the display in the first embodiment of the invention.

With reference to FIG. 1, the first embodiment provides a method for detecting a synchronization signal of a display, the method comprises:

A first step, prestoring a standard synchronization signal table in a memory, wherein, the standard synchronization signal table stores standard V-sync frequencies and standard horizontal synchronization signal sub-tables corresponding to the standard V-sync frequencies, each standard horizontal synchronization signal sub-table stores all standard frequencies of horizontal synchronization signals and resolutions corresponding to one standard frequency of vertical synchronization signal, which is shown as following program.

A V-sync table and an H-sync table (the standard synchronization signal table) are created as follows:

```
typedef struct V_SYNCTBL {
        unsigned int    v_sync_hz;
                        H_SYNCTBL       *h_sync_tbl;
                        char            h_tbl_cnt;
} V_SYNCTBL;
typedef struct H_SYNCTBL {
        unsigned int    hsync_high_khz;
        char            t_mode;
} H_SYNCTBL;
```

Preferably, the standard V-sync frequencies in the standard synchronization signal table are from 55 Hz to 76 Hz and values thereof are integers. An actual frequency of vertical synchronization signal of a normal display is within the range from 55 Hz to 76 Hz, and of course, the range of the V-sync frequency may be changed depending on the display. In order to better understand, for example, the program wherein the standard V-sync frequencies are within the range from 55 Hz to 76 Hz may be written as follows:

```
VSYNCTBL code V_syncTable[ ] = {
    { 55, H_syncTable_V55, sizeof(H_syncTable_V55) },     // 55Hz
    { 56, H_syncTable_V56, sizeof(H_syncTable_V56) },     // 56Hz
    { 57, H_syncTable_V57, sizeof(H_syncTable_V57) },     // 57Hz
    .
    .
    { 74, H_syncTable_V74, sizeof(H_syncTable_V74) },     // 74Hz
    { 75, H_syncTable_V75, sizeof(H_syncTable_V75) },     // 75Hz
    { 76, H_syncTable_V76, sizeof(H_syncTable_V76) },     // 76Hz
    {0}
// END
  };
```

It can be easily seen that each of the standard V-sync frequencies in the created synchronization signal table in the embodiment corresponds to one standard horizontal synchronization signal sub-table, for example, a standard V-sync frequency of 55 Hz corresponds to a standard horizontal synchronization signal sub-table of H_syncTable_V55.

A second step, obtaining an actual V-sync frequency of the display, comparing it with the standard V-sync frequencies in the standard synchronization signal table prestored in the first step, and selecting a standard V-sync frequency from the standard synchronization signal table as a candidate V-sync frequency so that difference between the candidate V-sync frequencies and the actual V-sync frequency is within a first error range.

Preferably, selecting a standard V-sync frequency from the standard synchronization signal table as a candidate V-sync frequency so that difference between the candidate V-sync frequency and the actual V-sync frequency is greater than −1 Hz and less than 1 Hz (within a first error range). Alternatively, other error range may also feasible, and the first error range from −1 Hz to 1 Hz adopted in the embodiment will make the selected candidate V-sync frequency more accurate.

A third step, obtaining an actual H-sync frequency of the display, and comparing it with the standard frequencies of horizontal synchronization signal in the standard horizontal synchronization signal sub-table which corresponds to the selected candidate V-sync frequency obtained in the second step, and obtaining a standard H-sync frequency as a correct H-sync frequency so that difference between the correct H-sync frequency and the actual H-sync frequency is within a second error range, thereby a resolution of the display is obtained. Taking the candidate V-sync frequency of 75 Hz as an example, the relationship between its corresponding standard H-sync frequencies and resolutions is shown by the following program.

```
H_SYNCTBL code H_syncTable_V75 [ ] = {
        {HS_KHZ(37.5+5)          ,M_640×480_75 },
        {HS_KHZ(46.9+1.9)       ,M_800×600_75 },
        {HS_KHZ(49.725+3)        ,M_832×624_75},
        {HS_KHZ(60.0+5)          ,M_1024×768_75},
        {HS_KHZ(66.5+1.4)       ,M_1152×864_75},
        {HS_KHZ(68.0+2)          ,M_1152×870_75},
        {HS KHZ(75.0+2)           ,M_1280×960_75},
        {HS_KHZ(80.0+3)          ,M_1280×1024_75},
};
```

It can be seen from the above program, when the actual H-sync frequency of the display is detected, it is compared with all of the standard H-sync frequencies in the standard synchronization signal sub-table corresponding to the candidate V-sync frequency detected in the above step, and once upon a correct H-sync frequency is obtained, a resolution of the display is obtained.

If a plurality of candidate V-sync frequencies satisfying the condition of the first error range are obtained in the above step, then a plurality of standard H-sync frequencies may also be obtained, and when there are the same standard H-sync frequencies corresponding to the obtained different candidate V-sync frequencies, the first error range is narrowed down (for example, changed to a range from 0 to 0.5), and the second step is returned back to select candidate V-sync frequencies again according to the new first error range.

Preferably, a standard H-sync frequency is obtained from candidate H-sync frequencies (i.e. all standard H-sync frequencies in the standard synchronization signal sub-table corresponding to the selected candidate V-sync frequency) as the correct H-sync frequency so that difference between the correct H-sync frequency and the actual H-sync frequency is larger than −1 KHz and less than 1 KHz (within the second error range). Alternatively, other error range may also be feasible, and the second error range from −1 KHz to 1 KHz adopted in the embodiment will make the selected candidate H-sync frequencies more accurate.

If no correct H-sync frequency is found (if the detected resolution of the display is so high that it is not set in the prestored standard horizontal synchronization signal sub-table), then a new standard H-sync frequency is added into the standard horizontal synchronization signal sub-table so that a new standard horizontal synchronization signal sub-table is formed, and a correct H-sync frequency may be obtained according to the standard H-sync frequencies in the new standard horizontal synchronization signal sub-table.

In the step, the candidate H-sync frequencies are obtained from the relationship between the candidate V-sync frequencies and the resolutions, hereafter, a correct H-sync frequency is obtained by comparing the candidate H-sync frequencies and the actual H-sync frequency, and if no correct H-sync frequency is detected, then a new standard H-sync frequency is added into the standard horizontal synchronization signal sub-table so as to continue to detect until a correct H-sync frequency is obtained.

In the method for detecting the synchronization signal of the display in the embodiment, the candidate V-sync frequency is firstly detected, next all of the standard H-sync frequencies corresponding to the candidate V-sync frequency are obtained according to the correspondence between the V-sync frequency and the standard horizontal synchronization signal sub-table, and finally the correct H-sync frequency is obtained through comparing the actual H-sync frequency and the standard H-sync frequencies, and thereby the resolution of the display is obtained. The resolution plays a key role in setting parameters such as the refresh frequency of the display later, and moreover, this method wherein the synchronization signal of the display is detected in steps may be performed quickly and accurately.

The Second Embodiment

Figure 2:
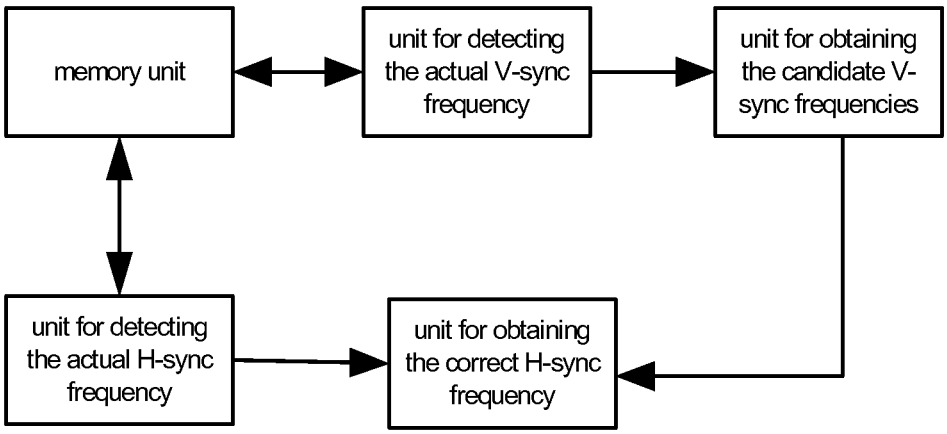
FIG. 2 is a structural diagram illustrating a device for detecting a synchronization signal of the display in the second embodiment of the invention.

With reference to FIG. 2, this embodiment provides a device for detecting a synchronization signal of a display comprising a memory unit for storing a standard synchronization signal table, wherein the standard synchronization signal table stores standard V-sync frequencies and standard horizontal synchronization signal sub-tables corresponding to the standard V-sync frequencies, and preferably, each standard horizontal synchronization signal sub-table stores all standard H-sync frequencies and resolutions corresponding to one standard V-sync frequency;

a unit for detecting an actual V-sync frequency of a display;

a unit for detecting an actual H-sync frequency of the display;

a unit for obtaining a standard V-sync frequency as a candidate V-sync frequency so that difference between the candidate V-sync frequency and the actual V-sync frequency is within a first error range, a unit for obtaining a standard H-sync frequency from the standard horizontal synchronization signal sub-table as a correct H-sync frequency so that difference between the correct H-sync frequency and the obtained actual H-sync frequency is within a second error range, by comparing the standard H-sync frequencies in the standard horizontal synchronization signal sub-table corresponding to the obtained candidate V-sync frequency, so that a solution of the display is obtained.

This device provided in the embodiment may detect the frequency of the synchronization signal of the display quickly and accurately.

The Third Embodiment

The invention provides a display comprising the above device for detecting the frequency of the synchronization signal of the display.

The display in the invention may be a liquid crystal display panel, a liquid crystal display, a liquid crystal television, an OLED display panel, an OLED television, a mobile phone, a pad or an electronic book etc.

It should be understood that above embodiments are just examples for illustrating the principle of the invention, however, the invention is not limited thereto. Various modifications and variations can be made by a person skilled in the art without departing from the spirit and the scope of the present invention. These modifications and variations should be considered to be within protection scope of the present invention.

The invention claimed is:

1. A method for detecting a synchronization signal of a display, comprising the steps of:

obtaining an actual frequency of vertical synchronization signal of the display, comparing the actual frequency of vertical synchronization signal with standard frequencies of vertical synchronization signal prestored in a standard synchronization signal table, and selecting a standard frequency of vertical synchronization signal from the standard synchronization signal table as a candidate frequency of vertical synchronization signal so that difference between the candidate frequency of vertical synchronization signal and the actual frequency of vertical synchronization signal of the display is within a first error range, wherein the standard synchronization signal table stores the standard frequencies of vertical synchronization signal and standard horizontal synchronization signal sub-tables corresponding to the standard frequencies of vertical synchronization signal, each standard horizontal synchronization signal sub-table stores all standard frequencies of horizontal synchronization signal and resolutions corresponding to one standard frequency of vertical synchronization signal;

obtaining an actual frequency of horizontal synchronization signal of the display, comparing the actual frequency of horizontal synchronization signal with the standard frequencies of horizontal synchronization signal in the standard horizontal synchronization signal sub-table which corresponds to the selected candidate frequency of vertical synchronization signal, and selecting a standard frequency of horizontal synchronization signal from the standard horizontal synchronization signal sub-table as a correct frequency of horizontal synchronization signal so that difference between the candidate frequency of horizontal synchronization signal and the actual frequency of horizontal synchronization signal is within a second error range, thereby a resolution of the display is obtained.

2. The method for detecting a synchronization signal of a display according to claim 1, wherein the first error range is from −1 Hz to 1 Hz.

3. The method for detecting a synchronization signal of a display according to claim 2, wherein the standard frequencies of vertical synchronization signal in the standard synchronization signal table are from 55 Hz to 76 Hz and values thereof are integers.

4. The method for detecting a synchronization signal of a display according to claim 1, wherein the second error range is from −1 Hz to 1 Hz.

5. The method for detecting a synchronization signal of a display according to claim 4, wherein the standard frequencies of vertical synchronization signal in the standard synchronization signal table are from 55 Hz to 76 Hz and values thereof are integers.

6. The method for detecting a synchronization signal of a display according to claim 1, wherein if a plurality of candidate frequencies of vertical synchronization signal are obtained and at least two of the standard frequencies of horizontal synchronization signal corresponding to the plurality of candidate frequencies of vertical synchronization signal are identical, the first error range is narrowed down to obtain a new first error range, and candidate frequencies of vertical synchronization signal are reselected according to the new first error range.

7. The method for detecting a synchronization signal of a display according to claim 6, wherein the standard frequencies of vertical synchronization signal in the standard synchronization signal table are from 55 Hz to 76 Hz and values thereof are integers.

8. The method for detecting a synchronization signal of a display according to claim 1, further comprising:

when there is no correct frequency of horizontal synchronization signal obtained, a new standard frequency of horizontal synchronization signal is added to the standard horizontal synchronization sub-table, so as to obtain a new standard horizontal synchronization sub-table.

9. The method for detecting a synchronization signal of a display according to claim 8, further comprising:

a correct frequency of horizontal synchronization signal is obtained from standard frequencies of horizontal synchronization signal in the new standard horizontal synchronization sub-table.

10. The method for detecting a synchronization signal of a display according to claim 9, wherein the standard frequencies of vertical synchronization signal in the standard synchronization signal table are from 55 Hz to 76 Hz and values thereof are integers.

11. The method for detecting a synchronization signal of a display according to claim 8, wherein the standard frequencies of vertical synchronization signal in the standard synchronization signal table are from 55 Hz to 76 Hz and values thereof are integers.

12. The method for detecting a synchronization signal of a display according to claim 1, wherein the standard frequencies of vertical synchronization signal in the standard synchronization signal table are from 55 Hz to 76 Hz and values thereof are integers.

13. A device for detecting a synchronization signal of a display, comprising:

a memory for storing a standard synchronization signal table, wherein the standard synchronization signal table stores standard frequencies of vertical synchronization signal and standard horizontal synchronization signal sub-tables corresponding to the standard frequencies of vertical synchronization signal, each standard horizontal synchronization signal sub-table stores all standard frequencies of horizontal synchronization signal and resolutions corresponding to one standard frequency of vertical synchronization signal;

an actual vertical synchronization signal frequency detector for detecting an actual frequency of vertical synchronization signal of the display;

an actual horizontal synchronization signal frequency detector for detecting an actual frequency of horizontal synchronization signal of the display;

a candidate vertical synchronization signal frequency obtainer for obtaining a standard frequency of vertical synchronization signal as a candidate frequency of vertical synchronization signal so that difference between the candidate frequency of vertical synchronization signal and the actual frequency of vertical synchronization signal is within a first error range, a correct horizontal synchronization signal frequency obtainer for obtaining a standard frequency of horizontal synchronization signal as a correct frequency of horizontal synchronization signal so that difference between the correct frequency of horizontal synchronization signal and the actual frequency of horizontal synchronization signal is within a second error range by comparing the standard frequencies of horizontal synchronization signal in the standard horizontal synchronization signal sub-table corresponding to the candidate frequency of vertical synchronization signal with the actual frequency of horizontal synchronization signal, thereby a resolution of the display is obtained.

14. A display comprising the device for detecting a synchronization signal of a display according to claim 13.

* * * * *